US008534766B2

(12) United States Patent
Ritchey et al.

(10) Patent No.: US 8,534,766 B2
(45) Date of Patent: Sep. 17, 2013

(54) INDEXABLE CUTTING TOOL SYSTEM

(75) Inventors: Cary D. Ritchey, Roaring Springs, PA (US); Wayne H. Beach, Roaring Springs, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 12/107,298

(22) Filed: Apr. 22, 2008

(65) Prior Publication Data

US 2009/0261646 A1 Oct. 22, 2009

(51) Int. Cl.
*E21C 35/19* (2006.01)

(52) U.S. Cl.
USPC ..... 299/106; 299/108

(58) Field of Classification Search
USPC ..... 299/102–104, 106–107, 110
See application file for complete search history.

(56) References Cited

U.S. PATENT DOCUMENTS

| | | | | |
|---|---|---|---|---|
| 3,318,401 | A * | 5/1967 | Carbert | 175/413 |
| 3,945,681 | A * | 3/1976 | White | 299/107 |
| 4,316,636 | A * | 2/1982 | Taylor et al. | 299/109 |
| 4,333,687 | A | 6/1982 | Barnstorf | |
| 4,346,934 | A | 8/1982 | College et al. | |
| 4,462,638 | A | 7/1984 | DenBesten | |
| 4,470,210 | A | 9/1984 | Hahn | |
| 4,595,241 | A | 6/1986 | Gilbert et al. | |
| 4,666,214 | A | 5/1987 | Beach | |
| 4,727,664 | A * | 3/1988 | Hemphill | 37/455 |
| 4,915,454 | A * | 4/1990 | Southern | 299/108 |
| 5,007,685 | A * | 4/1991 | Beach et al. | 299/85.2 |
| 5,067,775 | A | 11/1991 | D'Angelo | |
| 5,106,166 | A | 4/1992 | O'Neill | |
| 5,833,017 | A * | 11/1998 | Woods et al. | 175/320 |
| 6,099,081 | A | 8/2000 | Warren et al. | |
| 6,364,420 | B1 | 4/2002 | Sollami | |
| 6,546,977 | B1 | 4/2003 | Monyak et al. | |
| 6,585,327 | B2 | 7/2003 | Sollami | |
| 6,712,431 | B1 * | 3/2004 | Bosch et al. | 299/104 |
| 6,871,859 | B2 | 3/2005 | Lundblad et al. | |
| 2003/0015907 | A1 | 1/2003 | Sollami | |
| 2004/0174065 | A1 | 9/2004 | Sollami | |

FOREIGN PATENT DOCUMENTS

EP 231107 A * 8/1987

* cited by examiner

*Primary Examiner* — Sunil Singh
(74) *Attorney, Agent, or Firm* — Matthew W. Smith, Esq.

(57) ABSTRACT

A system for excavating and/or trenching hard and soft ground material includes a support block having a bore with a cylindrical portion and a non-cylindrical portion with flat surfaces and a cutting tool mounted in the bore, which may be a non-rotatable cutting tool having a shank with flat surfaces or a rotatable cutting tool having a shank with a cylindrical portion. The non-cylindrical portion of the bore rotatably engages the cylindrical portion of the rotatable cutting tool and the flat surfaces of the bore engage the flat surfaces of the non-rotatable cutting tool. A further embodiment includes a support block having a bore with flat surfaces along the entire length of the bore that engage the flat surfaces of the shank of the non-rotatable cutting tool and which bore receives the cylindrical portion of the shank of the rotatable cutting tool but does not restrain rotation thereof. In yet another embodiment, the support block may have two non-cylindrical portions and a single cylindrical portion, while the cutting tool may have a shank with two non-cylindrical portions and a single cylindrical portion corresponding to those within the bore of the support block.

7 Claims, 19 Drawing Sheets

INDEXABLE CUTTING TOOL SYSTEM

BACKGROUND OF THE INVENTION

1. Field of the Invention

This invention relates to earth working machines and, more particularly, to a cutting system for excavating different types of substances, such as, rock or dirt, and which includes a support block configured to receive a rotatable cutting tool, such as a conical bit cutting tool, or a non-rotatable, indexable cutting tool, such as a spade bit cutting tool, depending on the type of material that is being trenched or excavated.

2. Description of Related Art

Many coal mining and/or construction tools generally include a plurality of bits for cutting into either hard material, such as concrete, asphalt, or rock, or into soft material, such as dirt. The bits are held by support blocks which are generally welded to a cutting chain, drum or wheel, and the blocks may be arranged so that alternating bits project from opposite sides of or staggered positions on the wheel, drum or chain.

Additionally, depending upon the material composition, it may be desirable to use a hybrid bit having properties of both the rotating conical bit and the non-rotating spade bit. Conical bits generally have a cylindrical surface and are rotatable within the support block.

The prior art is directed to different designs for the bits and/or support blocks for holding the bits. U.S. Pat. No. 4,915,454 is directed to a cutting apparatus having a fixed holder and an orientable holder. The fixed holder is mounted to a cutting drum and the orientable holder receives a cutting bit, which may be a conical bit or a forward-attack bit.

U.S. Pat. Nos. 3,318,401 and 4,316,636 are directed to construction tools having a block with a non-cylindrical bore adapted to accept a bit or a tool having a shaft with both a mating non-cylindrical portion and a cylindrical shaft portion.

U.S. Pat. No. 5,106,166 is directed to a mining bit holding system, which includes a bit holder that attaches to a rotatable drum of a mining machine. The bit holder includes a base portion and a body portion. The body portion has an aperture for receiving a co-axial sleeve. The sleeve has a bore for rotatably receiving a cutting bit. The sleeve and the bit holder are constructed such that the angular position of the sleeve may be fixed relative to the common axis of the aperture in the sleeve in a plurality of positions, and the sleeve may be rotated with respect to the axis of the aperture of the body portion to another position and then fixed in that position.

U.S. Pat. No. 4,727,664 is directed to an excavating machine having several support blocks, each having a cylindrical bore for receiving the cylindrical shank of a rotatable type bit. The support block is combined with a non-rotatable dirt type excavating tool. The tool has a cylindrical shank at one end made complementary respective to the block bore so that the shank can be telescopingly received in a captured manner within the bore of the support block. A stop means is formed on the block for engaging an abutment means of the tool and prevents axial rotation of the tool when the shank is received within the bore. The tool can be removed from the block, axially rotated into one of a plurality of axial positions respective to the block, and mounted within the bore of the support block.

U.S. Pat. No. 5,007,685 relates to a trenching tool assembly with dual indexing capabilities that includes a block formed with a tool shank bore and a cutter bit having a shank, which is insertable into the tool shank bore. The shank includes a hex portion. An indexing washer has a central opening that is shaped to engage the polygonal section of the cutter bit shank and to prevent relative rotation therebetween. The washer engages the tool block in a number of fixed positions. To change the angle of attachment of the cutter bit, the indexing washer is disengaged from the tool block and cutter bit shank. The indexing washer and cutter bit shank can be indexed as a unit or independently of one another.

U.S. Pat. No. 4,462,638 relates to a mining machine, which has cutting bits with conically-shaped heads and located in sockets of the support holders that have respective wear sleeves located on the shanks of the bits with the bit free to rotate with the sleeve interposed in the socket, thereby preventing wear mount. A retainer is engageable with a receptacle on the sleeve to ensure against undesired ejection of the bit.

U.S. Pat. No. 4,346,934 is directed to a non-rotatable excavating bit that has a forward working portion and a rearward shank portion, which is circular in cross-section and is adapted to fit into a circular bore of a support block. A tang extends from a shoulder and is adapted to fit down over and mate with a surface of the support block so as to hold the bit non-rotatable bit in the support block.

There is a need to provide a support block that can receive either a rotatable cutting bit, such as a conical bit, for cutting into hard surface materials or a non-rotatable cutting tool, such as a spade bit cutting tool, for cutting into soft surface materials.

It is therefore an object of the invention to provide an indexable cutting tool system for use in trenching and/or excavating different types of materials that includes a support block configured to selectively receive and retain either a non-rotatable, indexable cutting tool or a rotatable cutting tool.

SUMMARY OF THE INVENTION

The invention relates to a system for mounting a non-rotating and rotating mining and/or construction tool, comprising a support block, a cutting tool selected from the group consisting of a non-rotatable cutting tool having a shank and a rotatable cutting tool having a shank. The support block has a bore with a central axis extending therethrough and a cylindrical portion configured to selectively receive the rotatable cutting tool shank. The block also has a first non-cylindrical portion configured to selectively receive and index the non-rotatable cutting tool shank.

Another embodiment of the invention is directed to a system for mounting non-rotating and rotating mining and/or construction tools comprising a support block and a cutting tool selected from the group, consisting of a non-rotatable cutting tool and a rotatable cutting tool. The support block has a bore with a non-cylindrical portion extending along the entire length of the bore and is configured to selectively rotatably receive the rotatable cutting tool and to non-rotatably receive the non-rotatable cutting tool.

Yet another embodiment of the invention is directed to a non-rotatable cutting tool for cutting ground material adapted to be mounted in a bore of a support block, which has a cylindrical portion and an adjacent first non-cylindrical portion. The non-rotatable cutting tool includes a cutting end and a shank with a central axis extending therethrough and has a cylindrical portion that is adapted to be received in the cylindrical portion of the bore of the support block and an adjacent first non-cylindrical portion that is adapted to engage the first non-cylindrical portion of the bore of the support block when the non-rotatable cutting tool is mounted in the support block.

In yet another embodiment of the invention, a support block for supporting non-rotating and rotating mining and/or construction tools and has a bore with a first non-cylindrical portion configured to selectively receive and index a non-rotatable cutting tool and a cylindrical portion configured to selectively receive a rotatable cutting tool.

DETAILED DESCRIPTION OF THE INVENTION

The present invention will be described with reference to the accompanying drawings, where like reference numbers correspond to like elements. The drawings are for purposes of illustrating the preferred embodiments of the invention only and not for purposes of limiting the same.

Figure 10:
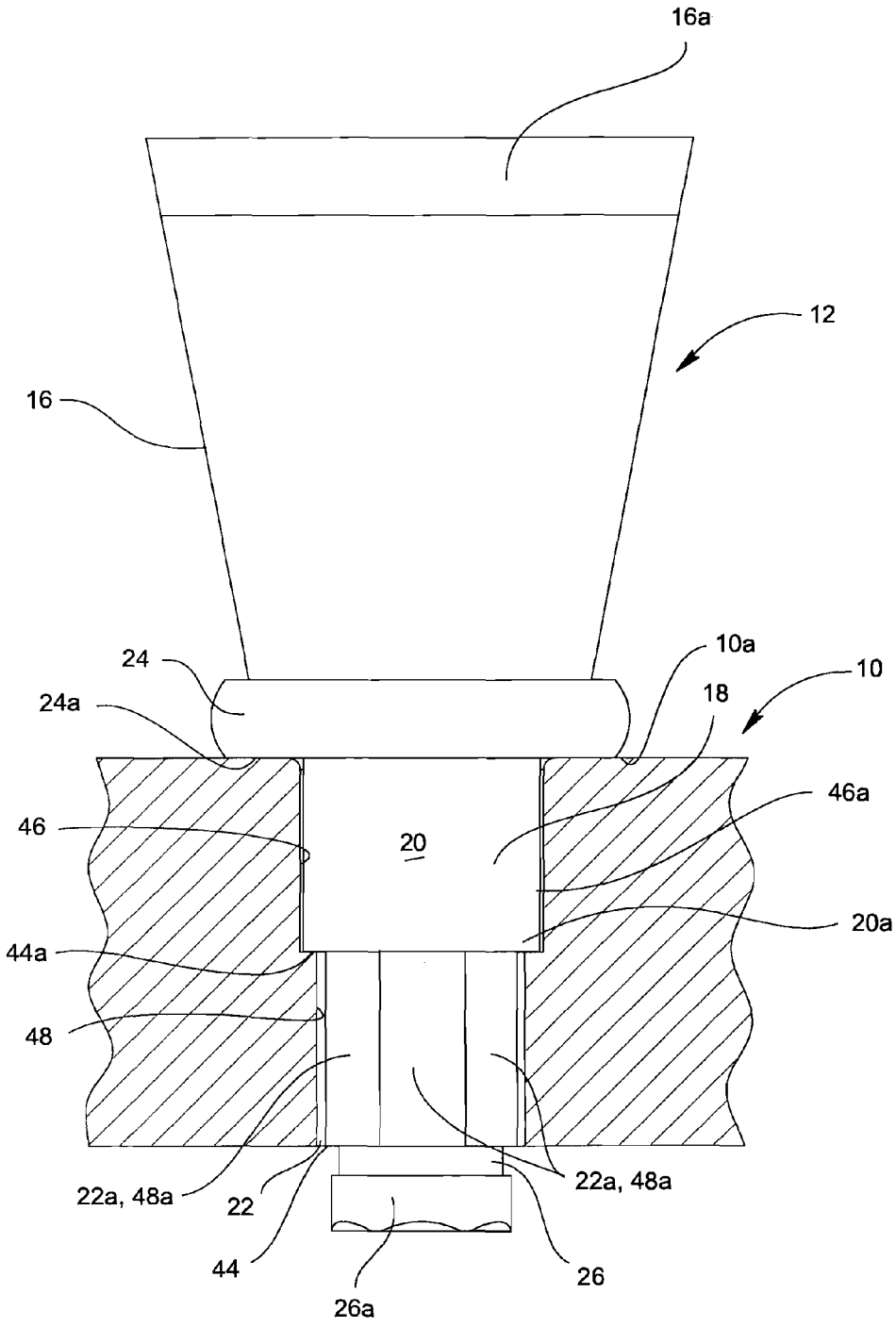
FIG. 10 is an enlarged side view of a spade cutting tool inserted into the bore of a support block of the invention.
Figure 11:
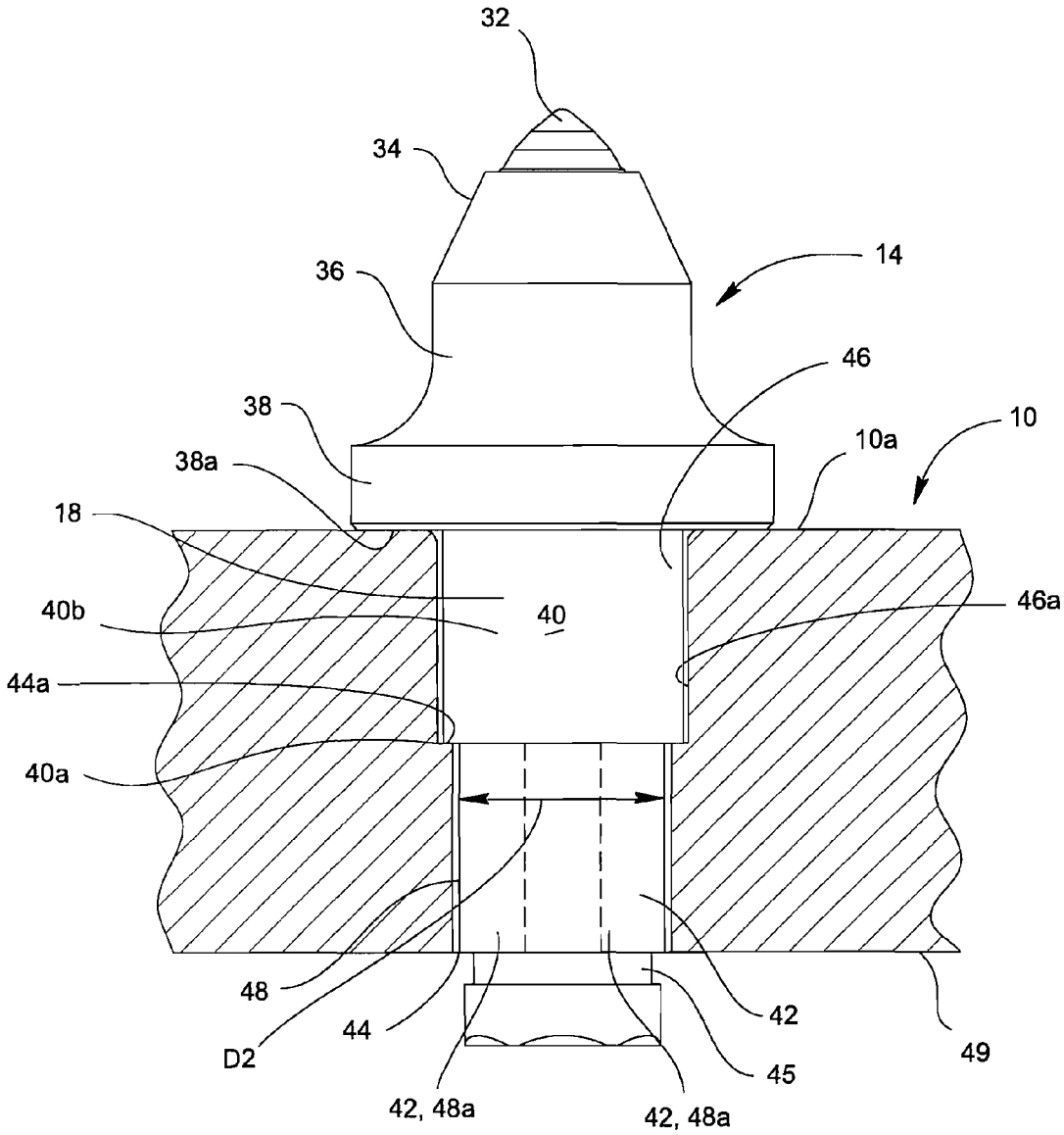
FIG. 11 is an enlarged side view of a conical bit tool inserted into the bore of a support block of the invention.
Figure 12:
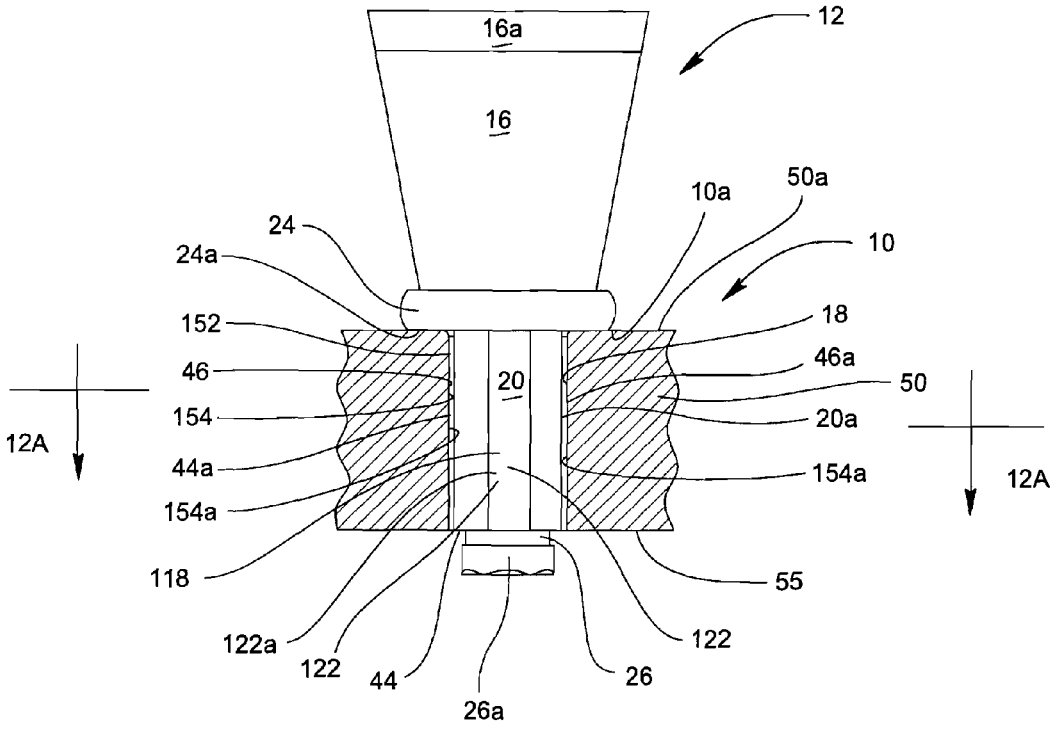
FIG. 12 is an enlarged side view of a spade cutting tool inserted in a support block of a further embodiment of the invention.
Figure 13:
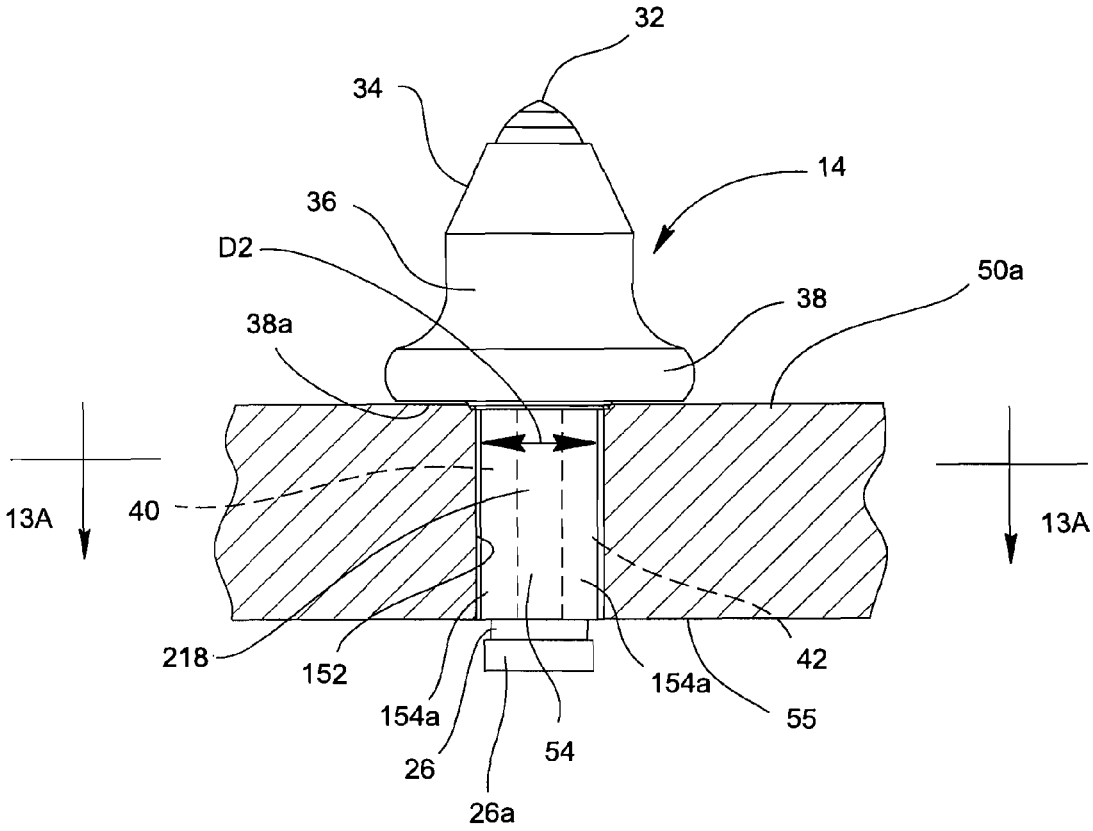
FIG. 13 is a side view of a conical bit tool inserted in a support block of a further embodiment of the invention.

FIGS. 1-11 pertain to a support block 10 of an embodiment of the invention, and FIGS. 12-13 pertain to a support block 50 of a further embodiment of the invention.

Figure 1:
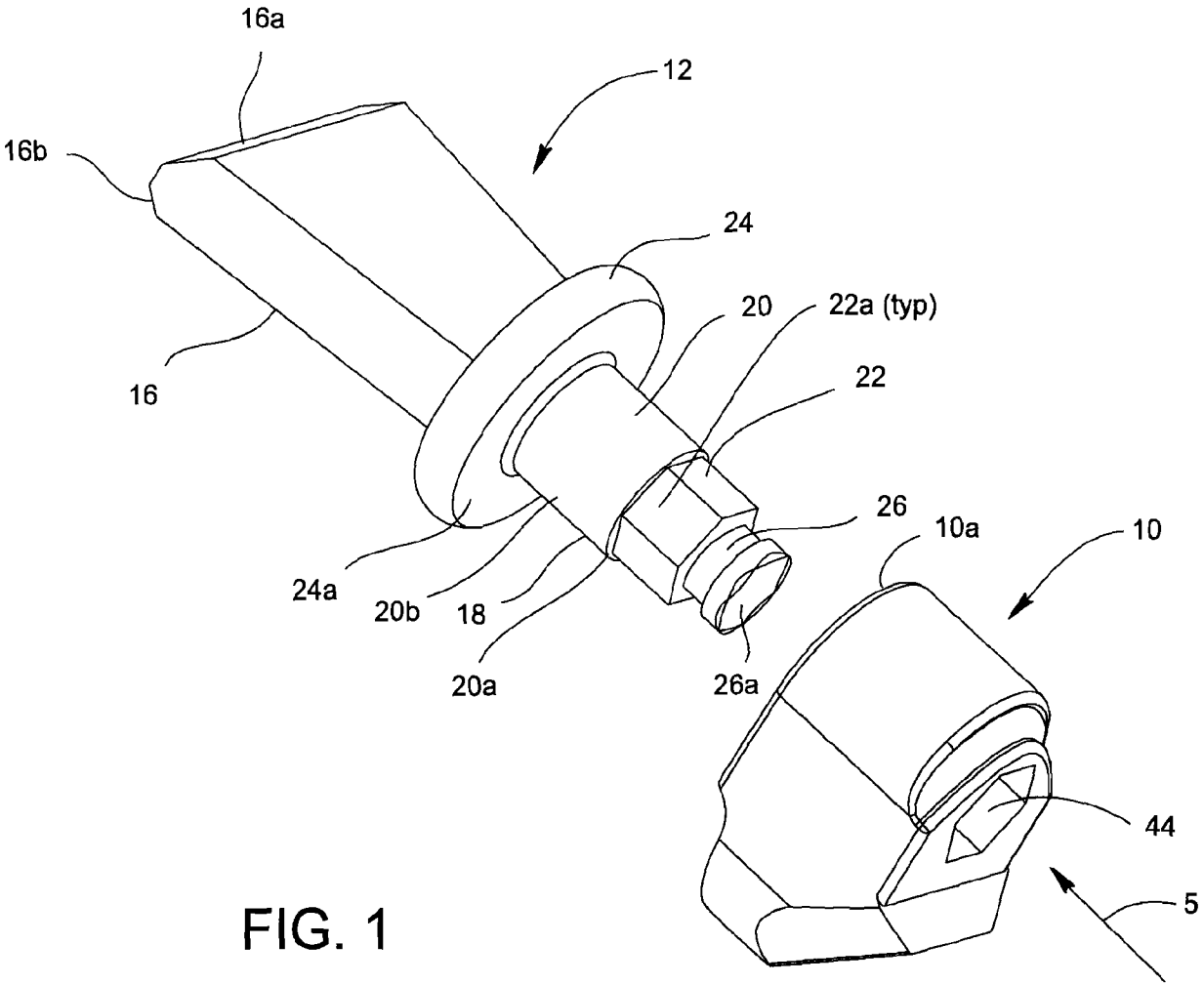
FIG. 1 is a perspective side view of a support block and a spade cutting tool insertable in a support block of the invention.
Figure 2:
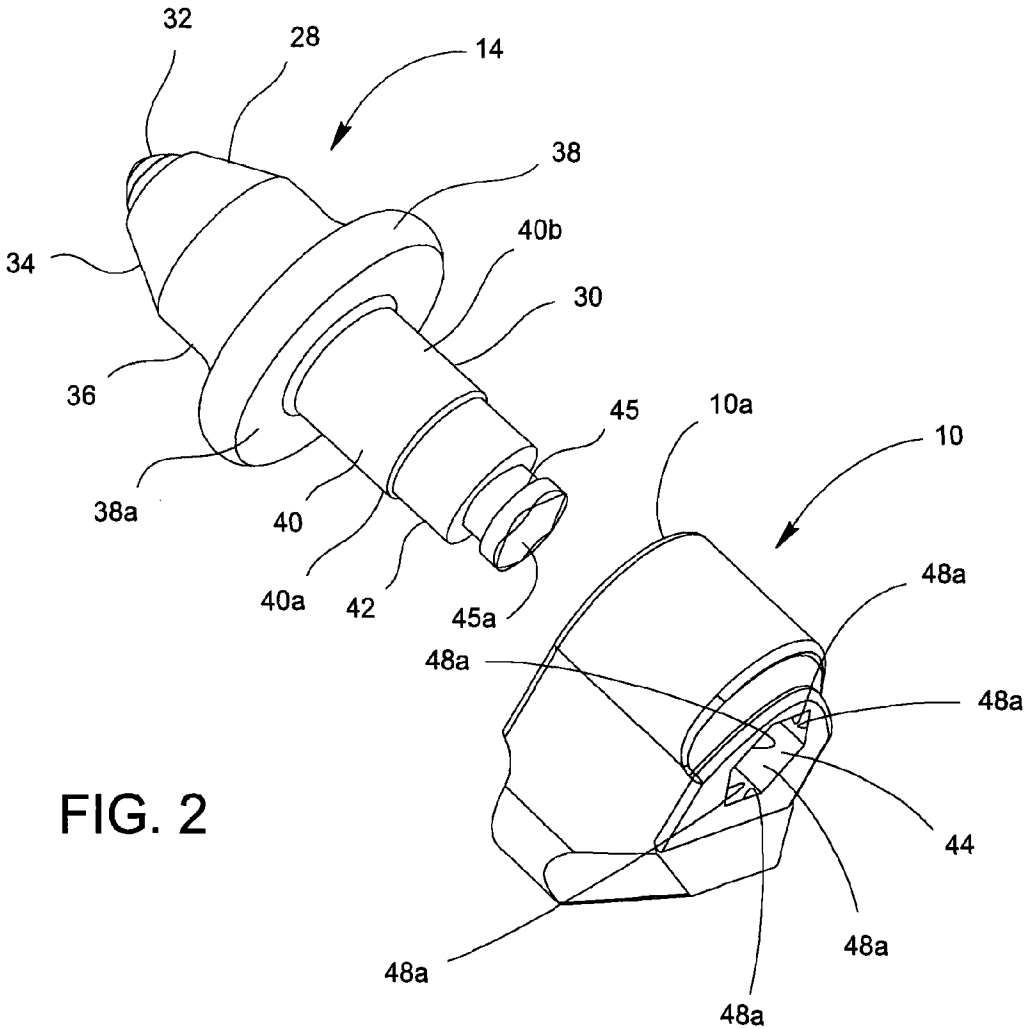
FIG. 2 is a perspective side view of a support block and a conical bit tool insertable in the support block of the invention.
Figure 3:
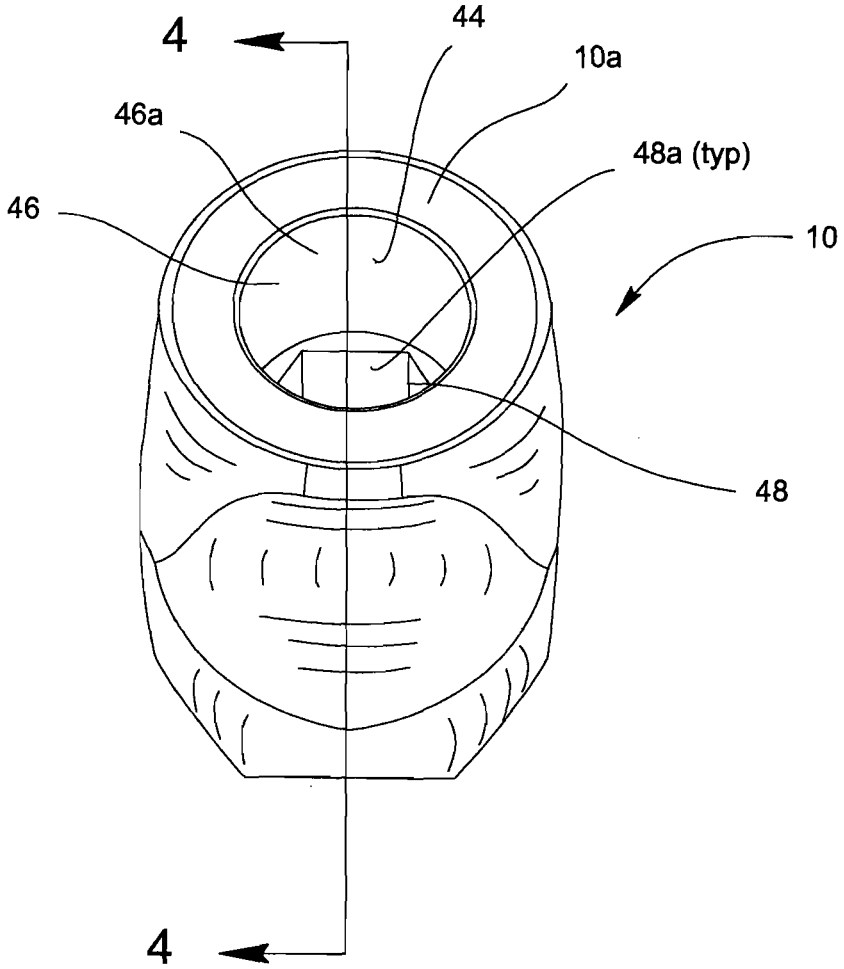
FIG. 3 is an front perspective view of the support block of FIG. 1.

As shown in FIG. 1, a support block generally indicated at 10 is configured to receive and retain either a non-rotatable indexable cutting tool, referred to as a spade bit cutting tool, generally indicated at 12, or as shown in FIG. 2. The support block 10 is configured to receive and retain a rotatable cutting tool, that is, a conical bit cutting tool, generally indicated at 14, depending on the type of material that is being trenched or excavated. Support block 10 is one of a plurality of such support blocks mounted around the outside of the generally circular drum (not shown) or on a movable chain or track (not shown) in a manner known to those skilled in the art.

Referring particularly to FIG. 1, the spade bit cutting tool 12 includes a forward cutting end 16 and a shank 18 or rear end thereof. The forward cutting end 16 includes an angled nose portion having angled surfaces 16*a* and 16*b*. Forward cutting end 16 is preferably made of a hard wear-resistant material, such as one of a number of refractory coated cemented carbide materials, which are well known in the art. The cemented carbide may include tungsten carbide, titanium carbide or TiC—TiN. Shank 18 or the rear end of spade bit cutting tool 12 has an upper cylindrical portion 20 and a lower non-cylindrical or indexable portion 22 adjacent to the upper cylindrical portion 20. Lower non-cylindrical portion 22, as shown in FIG. 1, has several flat indexing surfaces 22*a* circling around the lower indexable portion 22. A flange portion 24 has a diameter greater than that of the shank 18, and separates the forward cutting end 16 from the shank 18. The flange portion 24 is shaped so that when the shank 18 is inserted into the support block 10, a bottom surface 24*a* of flange portion 24 rests against a top surface 10*a* (FIG. 1) of support block 10. The lower indexable portion 22 of shank 18 includes a reduced diameter area portion 26 having an end 26*a*. The reduced diameter area 26 is configured to receive a retaining pin or clip (not shown in FIG. 1) for securing and mounting the spade cutting tool 12 to support block 10 when shank 18 is inserted in the support block 10.

Referring particularly to FIG. 2, the rotatable cutting tool or conical bit cutting tool 14 is rotatable within the support block 10 in a manner well known to those skilled in the art. Conical bit cutting tool 14 includes a forward cutting end 28 and a shank 30 or rear end thereof. The forward cutting end 28 includes a hardened nose 32, preferably made of a hard wear-resistant material such as one of a number of refractory coated cemented carbide materials, which are well known in the art. The cemented carbide may include tungsten carbide, titanium carbide or TiC—TiN. The forward cutting edge 28 also includes a tapered portion 34, an enlarged portion 36 and a flange portion 38, which separates the enlarged portion 36 and the shank 30. The flange portion 38 is shaped so that when the shank 30 is inserted into the support block 10, a bottom surface 38*a* of the flange portion 38 rests against the top surface 10*a* (FIG. 2) of the support block 10. The shank 30 or the rear end of conical bit cutting tool 14 has an upper cylindrical portion 40 and a lower cylindrical portion 42, which is adjacent to the upper cylindrical portion 40. The lower cylindrical portion 42 generally is configured with a reduced diameter portion 45 adjacent an end 45*a* to accept a retaining pin or clip (not shown), which secures the conical bit cutting tool 14 in the support block 10 in a manner well-known to those skilled in the art. Such a retaining pin or clip may be similar to that disclosed in the aforesaid United States Patent Application Publication No. U.S. 2003/0015907 A1, published Jan. 23, 2003, to Phillip A. Sollami, and may be a spring steel retaining clip which is positioned over the shank 30 of the conical bit cutting tool 14 and shaped so that when the cutting tool 14 is inserted into the support block 10, the retaining clip will secure the conical cutting tool 14 therein, while allowing it to rotate from external forces. Alternatively, the shank may be secured within a bore of a support block using an expansible clip which fits within a groove around the shank and engages the walls of the bore, in a manner similar to that illustrated and described in U.S. Pat. No. 4,316,636, assigned to the Assignee of the present application and for which the contents are hereby incorporated by reference.

Figure 4:
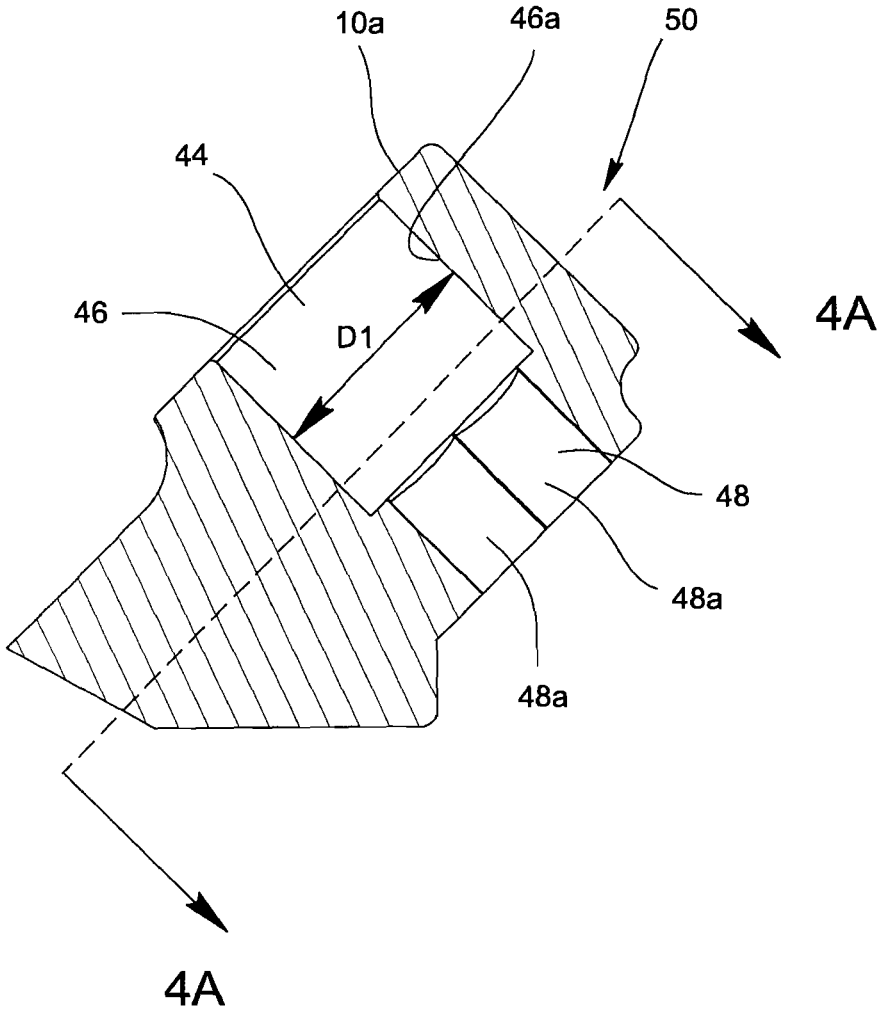
FIG. 4 is a cross-sectional view taken along lines 4-4 of FIG. 3.
Figure 5:
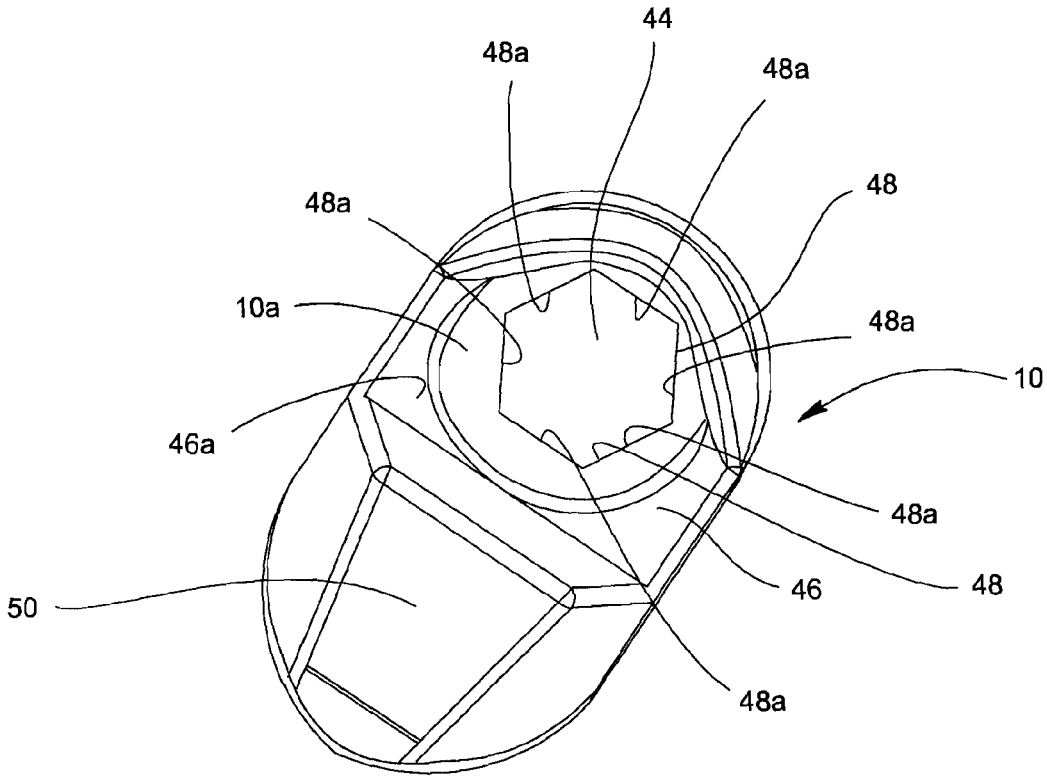
FIG. 5 is a view looking from the back directly into the bore of the support block along arrow 5 in FIG. 1.
Figure 6:
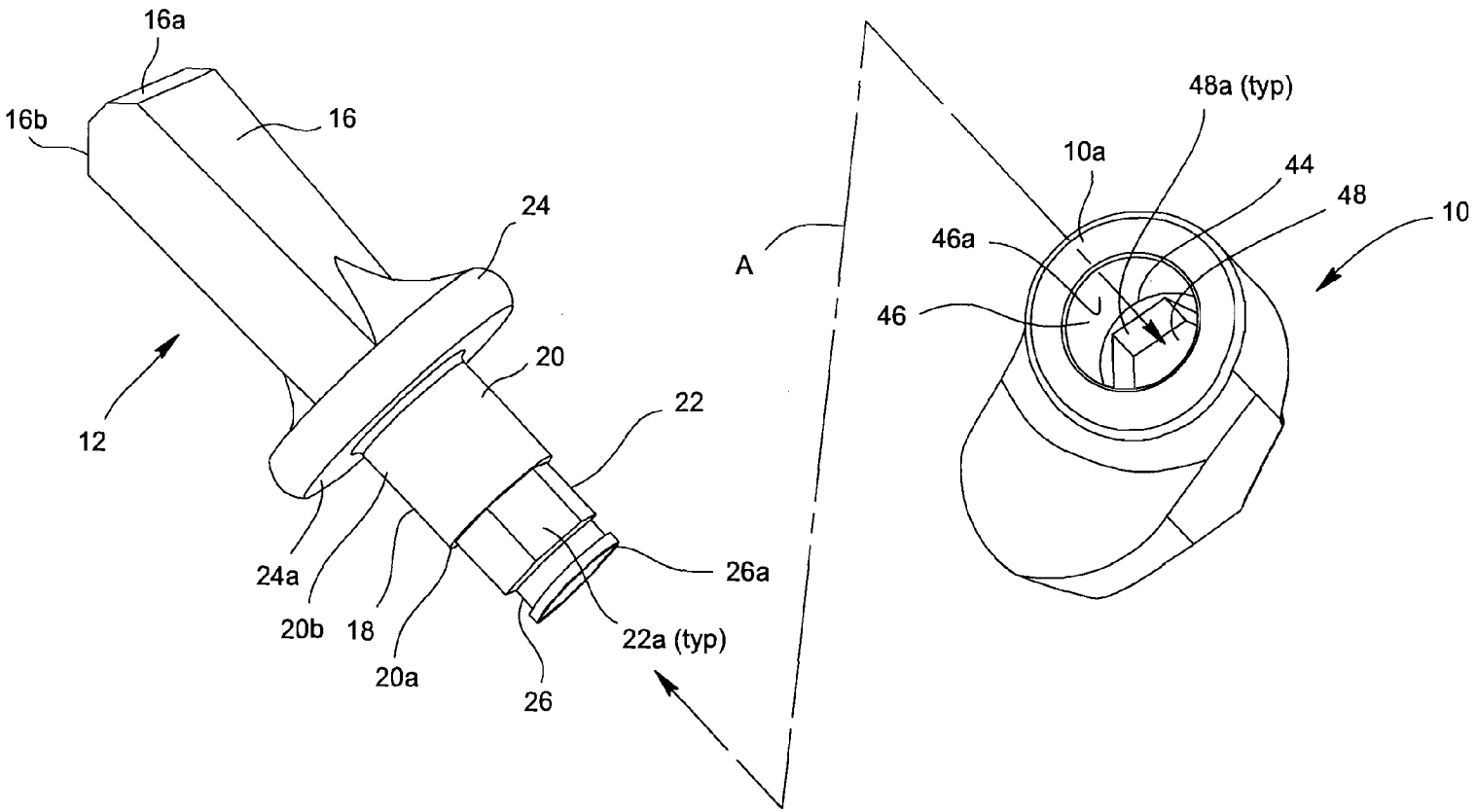
FIG. 6 is a perspective front view of the support block and a perspective side view of the spade bit cutting tool of FIG. 1 in an exploded relationship.
Figure 7:
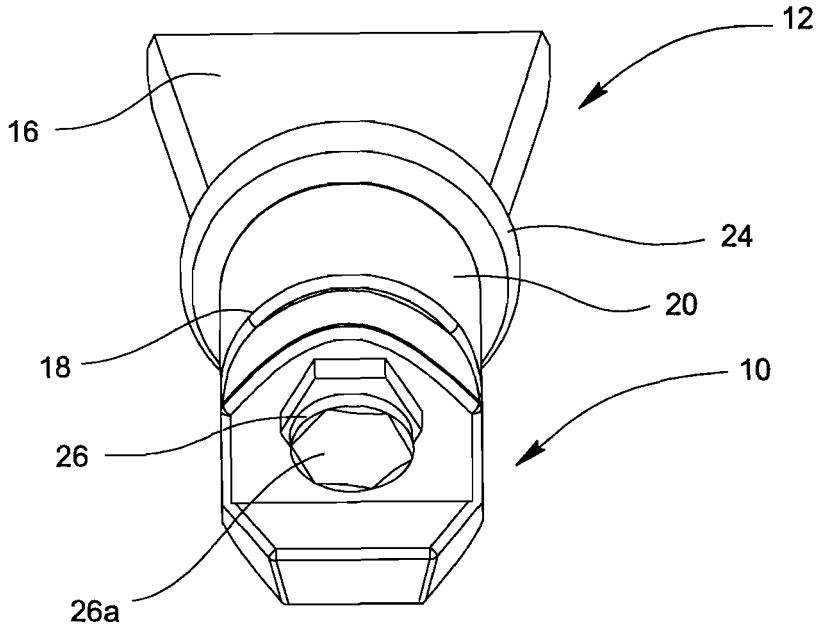
FIG. 7 is a perspective rear view of the spade cutting tool of FIG. 6A inserted into the support block of FIG. 6.

FIGS. 3-6 more clearly illustrate the configuration of support block 10. Support block 10 has a bore 44 with an upper cylindrical portion 46 with a cylindrical surface 46*a* and a lower non-cylindrical portion 48, which is adjacent to the upper cylindrical portion 46. The lower portion 48 of bore 44 has several flat surfaces 48*a* that encircle this lower portion 48 of bore 44 and correspond to the number of flat indexing surfaces 22*a* of the lower indexable portion 22 of spade bit cutting tool 12 (FIG. 1). FIG. 6 more clearly illustrates, by the double-headed arrow A, that the spade bit cutting tool 12 is to be inserted into the support block 10 and that the indexing surfaces 22*a* of the lower non-cylindrical or indexable portion 22 of spade bit cutting tool 12 are to be received within the bore 44 to engage flat surfaces 48*a* of the lower portion 48. Together, the indexing surfaces 22*a* of the lower non-cylindrical or indexable portion 22 of spade bit cutting tool 12 and the flat indexing surfaces 48*a* of non-cylindrical portion 48 of bore 44 of support block 10 prevent the spade bit cutting tool 12 from rotating within the support block 10.

Figure 4A:
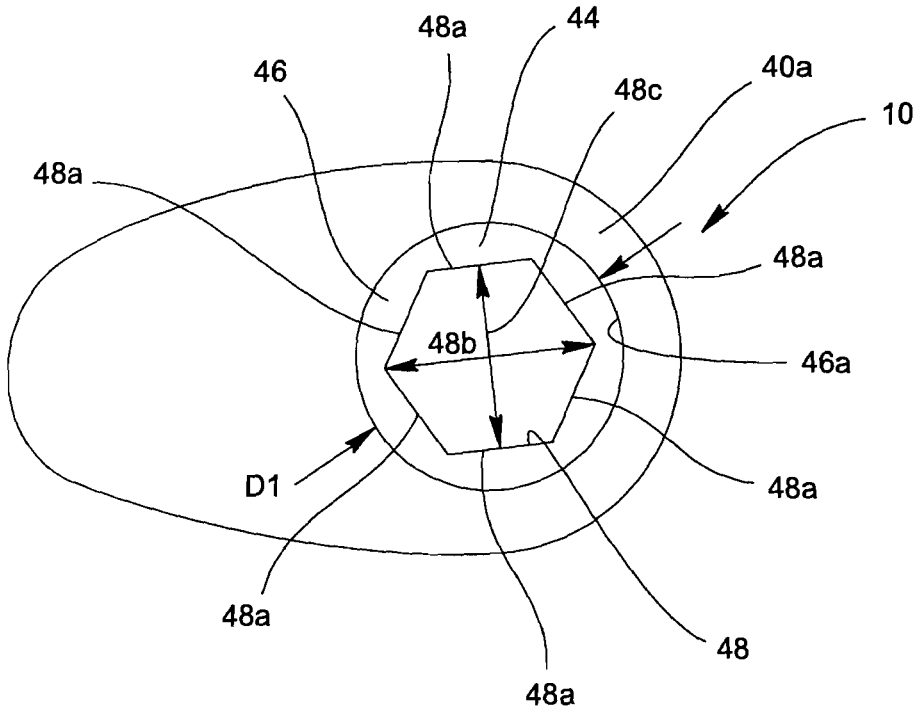
FIG. 4A is a cross-sectional view taken along lines 4A-4A of FIG. 4.

As shown best in FIG. 4, the upper cylindrical portion 46 of bore 44 has a diameter D1 that is greater than the width of the opening formed by the flat indexing surfaces 48*a* of the lower non-cylindrical portion 48, and that the upper cylindrical portion 46 and the lower non-cylindrical portion 48 are adjacent to each other. As best shown in FIG. 4A, the opening formed by the flat indexing surfaces 48*a* has a maximum width indicated by the double arrow 48*b* and a minimum width indicated by the double-headed arrow 48*c*. As best shown in FIGS. 4A and 5, the lower non-cylindrical portion 48 of bore 44 has six flat surfaces 48*a* that will correspond to and engage the flat surfaces 22*a* (FIG. 1) of the lower non-cylindrical or indexable portion 22 of the shank 18 of the spade bit cutting tool 12 when the spade bit cutting tool 12 is inserted into the bore 44. With respect to the conical bit cutting tool 14, the cylindrical surface 46*a* of the upper cylindrical portion 46 of bore 44 will rotatably support the upper cylindrical portion 40 (FIG. 2) of the shank 30 of the conical bit cutting tool 14 when the conical bit cutting tool 14 is inserted into bore 44.

Figure 8:
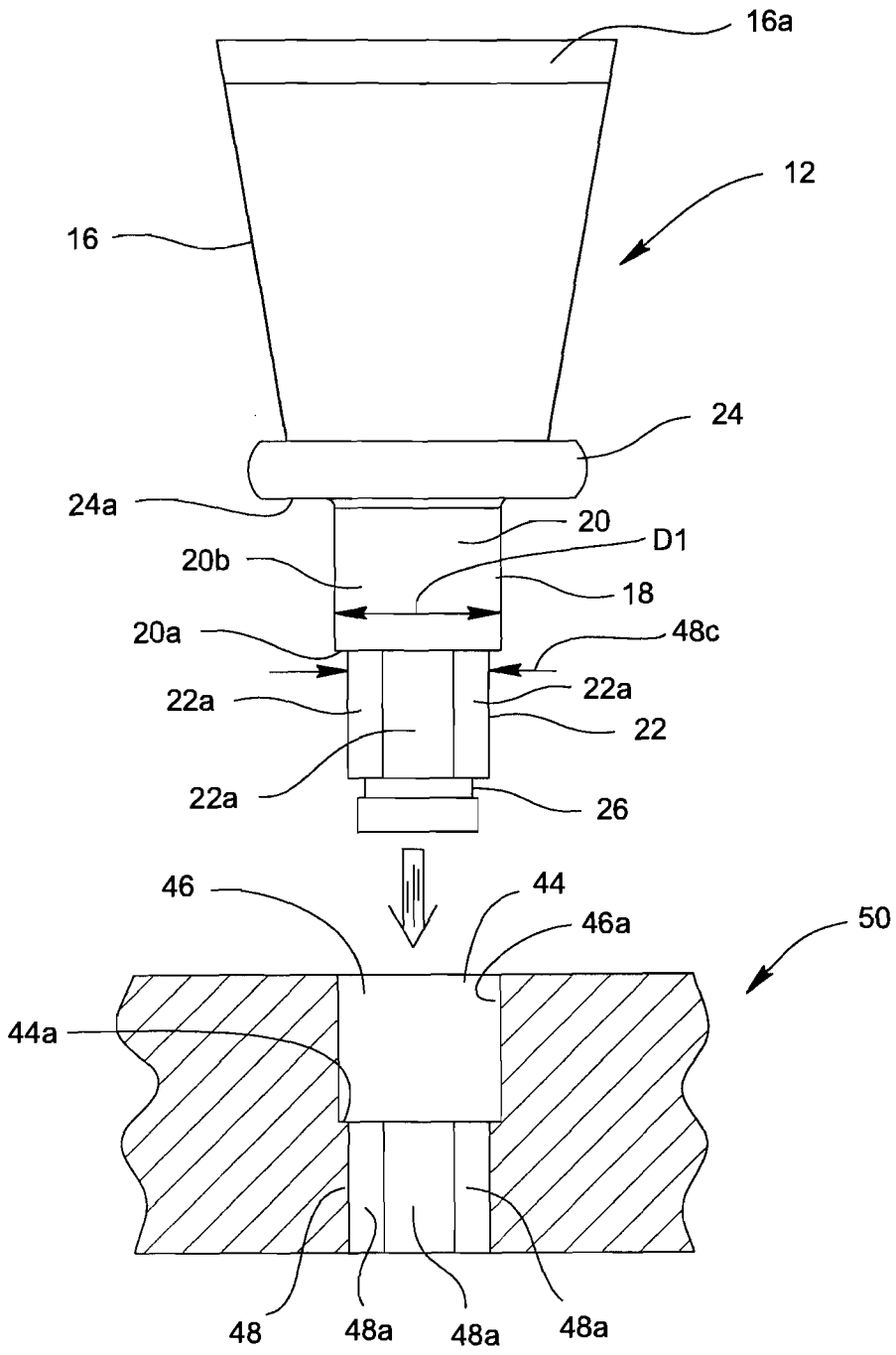
FIG. 8 is an exploded side view illustrating a spade cutting tool being inserted into a support block of the invention.

Referring particularly to FIGS. 8 and 10, when the spade bit cutting tool 12 is inserted into bore 44, the indexing flat surfaces 22*a* of the lower non-cylindrical or indexable portion 22 of the spade bit cutting tool 12 engages the corresponding flat surfaces 48*a* of the lower non-cylindrical portion 48 of bore 44 and the upper cylindrical portion 20 of shank 18 of spade bit cutting tool 12 is supported within the cylindrical surface 46*a* of the upper cylindrical portion 46 of bore 44. The shank 18, therefore, does not rotate within the bore 44. The shank 18 of the cutting tool 12 may be indexed within the bore 44 to position the cutting tool 12 at different angles within the support block 10.

Figure 9:
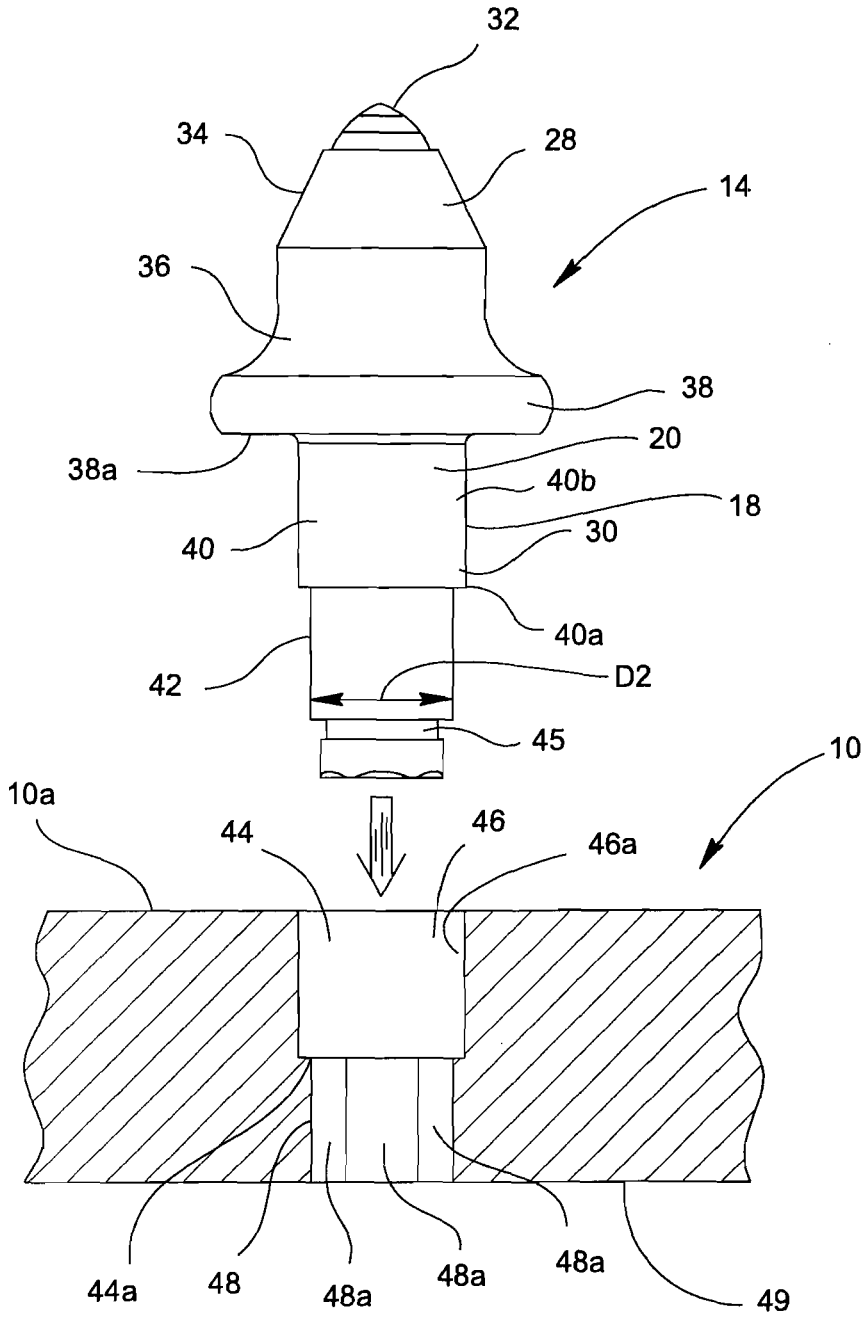
FIG. 9 is an exploded side view illustrating a conical bit tool being inserted into a support block of the invention.

Referring particularly to FIGS. 9 and 11, when the conical bit cutting tool 14 is inserted into bore 44, the upper cylindrical portion 40 of the cutting tool 14 is rotatably supported by the cylindrical surface 46*a* of the first upper portion 46 of bore 44, the lower cylindrical portion 42 of the conical bit cutting tool 14 is received in the lower non-cylindrical portion 48 of bore 44 and the retaining clip (not shown) will engage against the back surface 49 of the support block 10. However, the diameter D2 of the lower cylindrical portion 42 of the shank 18 is less than the minimum width 48*c* (FIG. 4A) of the non-cylindrical portion 48 of the bore 44. As a result, the conical bit cutting tool 14 may rotate within the bore 44 while the spade bit cutting tool 12 (FIG. 10) within the bore 44 may not rotate.

FIGS. 8 and 10 more clearly illustrate a spade bit cutting tool 12 being inserted into the bore 44 of the support 10, and FIGS. 9 and 11 more clearly illustrate a conical bit cutting tool 14 being inserted into the bore 44 of support 10, wherein the upper cylindrical portion 20 of shank 18 is positioned within the cylindrical surface 46*a* of the upper cylindrical portion 46 of bore 44.

Referring to FIGS. 8 and 10, when spade bit cutting tool 12 is inserted into bore 44, the bottom surface 24A of the flange portion 24 of the spade bit cutting tool 12 locates the spade bit cutting tool 12 within the bore 44. Additionally, a shoulder 20*a* of upper cylindrical portion 20 of shank 18 may abut a ledge 44*a* of bore 44. Similarly, referring again to FIGS. 9 and 11, when the conical bit cutting tool 14 is inserted into bore 44, the bottom surface 38*a* of the bottom flange portion 38 of the conical bit cutting tool 14 locates the cutting tool 14 within the bore 44. A shoulder 40*a* may abut the ledge 44*a* of bore 44. The length of the first upper portion 46 of bore 44 may be approximately the same length as the upper cylindrical portion 20 of shank 18 of the spade bit cutting tool 12 and approximately the same length as the upper cylindrical portion 40 of shank 30 of the conical bit cutting tool 14. The length of the lower portion 48 of bore 44 may be approximately the same length as the lower indexable portion 22 of shank 18 of the spade bit cutting tool 12 and approximately the same length as the lower cylindrical portion 42 of the conical bit cutting tool 14.

FIG. 10 more clearly illustrates the spade bit cutting tool 12 in bore 44 of support block 10, and FIG. 11 more clearly illustrates the conical bit cutting tool 14 in bore 44 of support block 10. As discussed, directing attention to FIGS. 4 and 4A, the upper cylindrical portion 46 of bore 44 has a diameter D1 that is greater than the opening formed by the flat indexing surfaces 48*a* of the lower non-cylindrical portion 48, and the opening formed by the flat indexing surfaces 48*a* has a maximum width indicated by the double-headed arrow 48*b* and a minimum width indicated by the double-headed arrow 48*c*. The block 10 is capable of accommodating the lower non-cylindrical portion 22 of the non-rotatable indexable cutting tool 12 (FIG. 1) and the lower cylindrical portion 42 of the shank 30 of the rotatable cutting tool 14 (FIG. 2). Of particular relevance, is that the width between indexing surfaces 22*a* of the lower non-cylindrical portion 22 of the non-rotatable indexable cutting tool 12 is slightly less than the minimum width 48*c* such that the lower non-cylindrical portion 48 non-rotatably supports the shank 18 of the cutting tool 12. However, the diameter D2 of the lower cylindrical portion 42 of the rotatable cutting tool 14 is less than the minimum width 48*c*, such that the lower cylindrical portion 42 and the entire shaft 18 may rotate within the bore 44 of the support block 10.

Figure 12A:
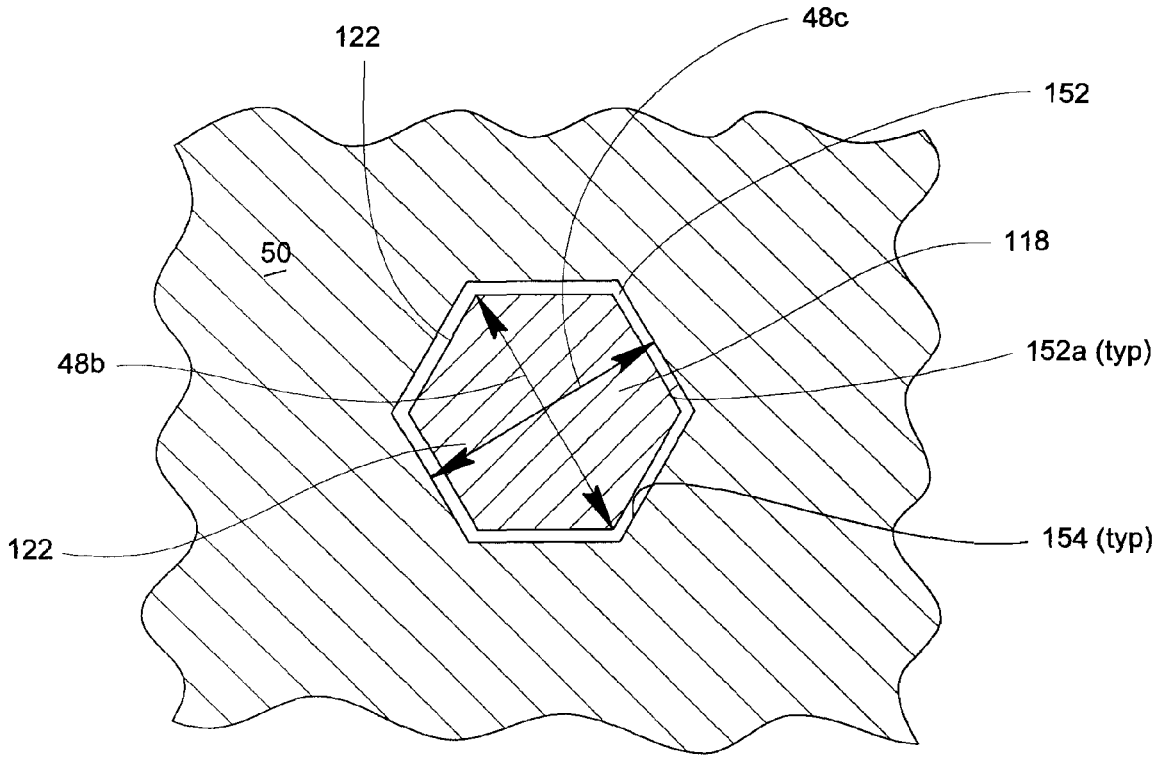
FIG. 12A is a view looking into the bore of the support block taken along lines 12A-12A in FIG. 12.
Figure 13A:
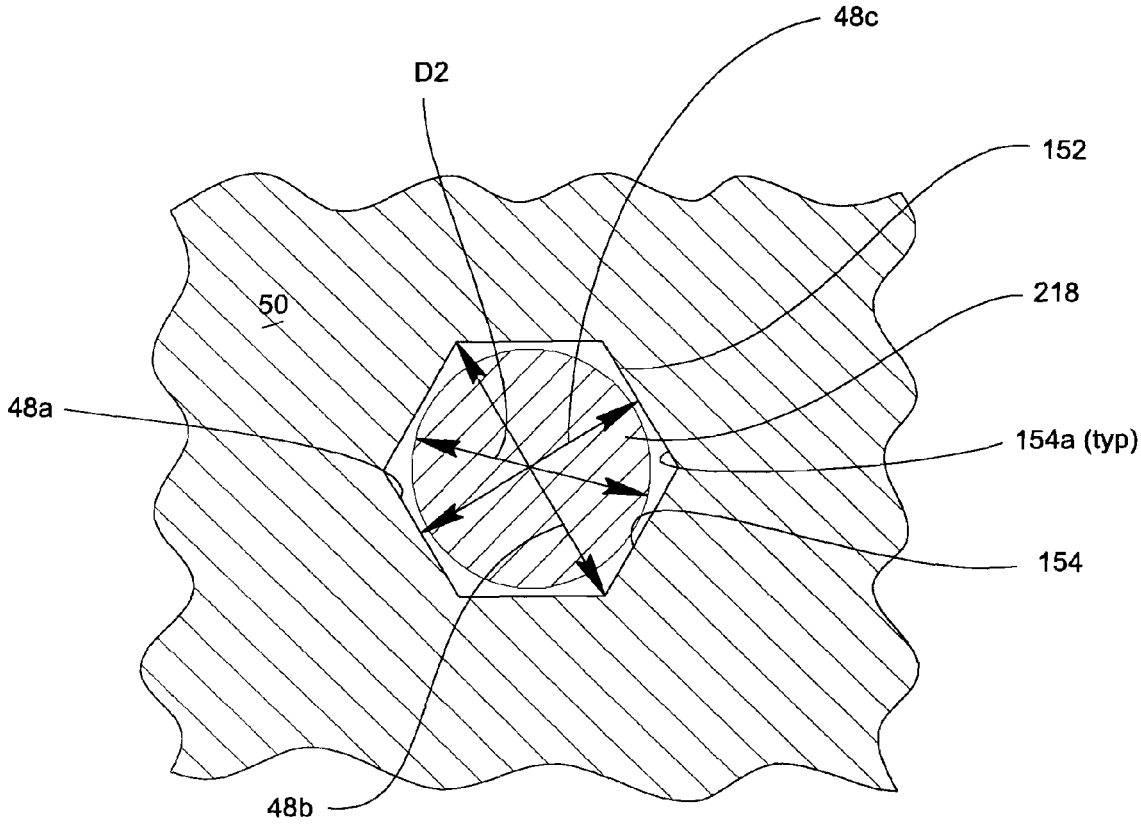
FIG. 13A is a view looking into the bore of the support block taken along lines 13A-13A of FIG. 13.

As stated above, FIGS. 12 and 13 illustrate a second embodiment of a support block 50 for selectively receiving either the spade bit cutting tool 12 of FIG. 12 or the conical bit cutting tool 14 of FIG. 13, respectively. In this embodiment, the support block 50 (FIG. 12) includes a flat outer surface 50*a* and a bore 152. Bore 152 has at least one non-cylindrical portion 154 extending along the entire length of the bore 152. A longitudinal view of bore 152, as shown in FIGS. 12A and 13A, shows six flat indexing surfaces 154*a* forming a hexagon where the opening of bore 152 has a maximum width 48*b* and a minimum width 48*c*. FIG. 12 shows that the indexable surfaces 122*a* extend along the length of the shank 118, such that the shank 118 is held iion-rotatably within the block 50 by matching flat indexing surfaces 154*a* of the non-cylindrical portion 154 extending along the length of the bore 152. As illustrated in FIG. 12A, the extended indexable portion 122 of shank 118 of the spade bit cutting tool 12 is received within the opening or bore 152 formed by the flat indexing surfaces 154*a*. Also, a retaining pin or clip (not shown) is attached to the reduced diameter 26 of shank 118 of the spade bit cutting tool 12 and engages against the back surface 55 of the support block 50 for retaining the spade bit cutting tool 12 in bore 152 of support block 50.

As illustrated in FIGS. 13 and 13A, the block 50 has a bore 152 with the same configuration as the bore 152 in FIG. 12. However, now the non-rotatable spade bit cutting tool 12 is replaced by the rotatable conical bit cutting tool 14. The shank 218 of the cutting tool 14 is cylindrical and fits within the flat indexing surface 154*a* of the non-cylindrical portion 154 of the bore 152, such that the shank 218 may rotate within the bore 152. In particular, the diameter D2 of the shank 218 must be less than the minimum width 48C of the bore 152.

As a result, even though the bore 152 of the block 50 has flat indexing surfaces 154*a* suitable to non-rotatably secure the shank 118 of the spade bit cutting tool 12, the same bore 152 of the block 50 may also accommodate the rotatable conical bit cutting tool 12 having the cylindrical shank 218.

Figure 14:
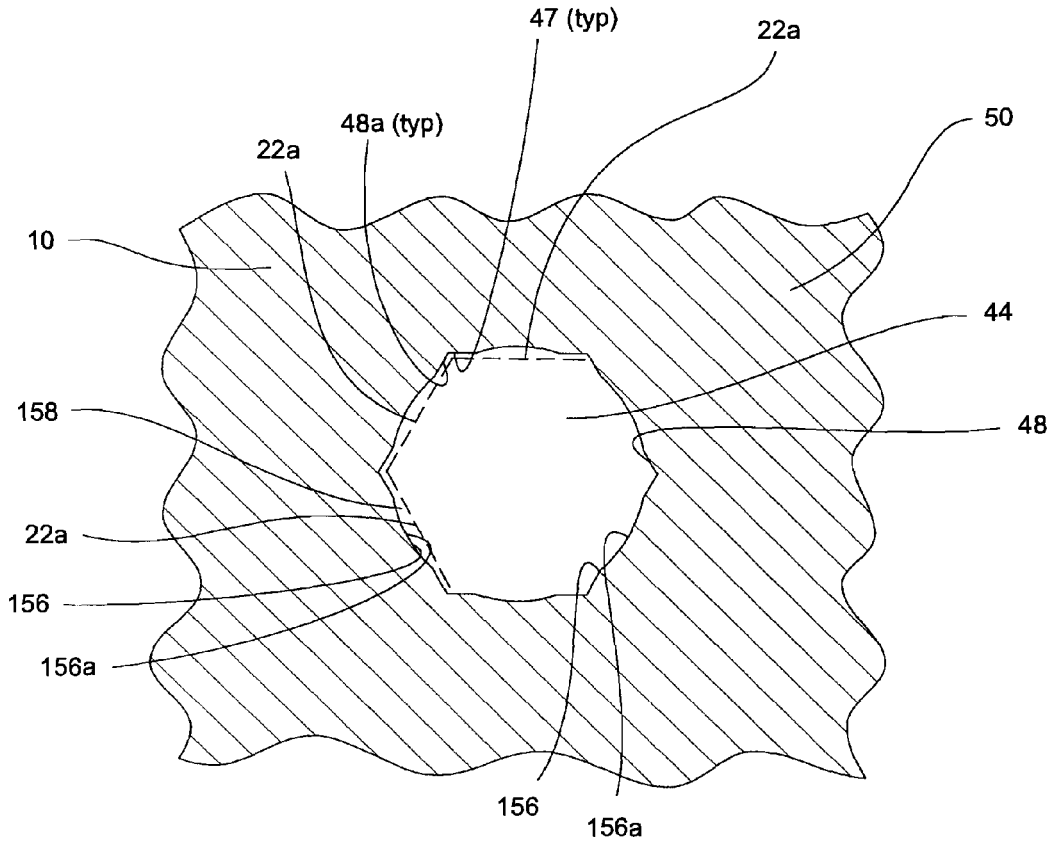
FIG. 14 is a view similar to that of FIG. 12A, but illustrates a bore modified with flats to accommodate the shank of a spade cutting tool.

As shown in FIG. 4, the non-cylindrical portion 48 of the bore 44 has flat indexing surfaces 48*a*. Directing attention to FIGS. 4 and 14, the bore 44 of block 50 may be formed by first machining to form the upper cylindrical portion 46 and a circular bore for the lower non-cylindrical portion 48. The lower non-cylindrical portion 48 may then be broached and machined to form corners 47 having flat surfaces 48*a* in the lower portion 48. As a result, the non-cylindrical portion 22 of the bore 44 will have curved segments 156 with curved surfaces 156*a* adjacent to the flat indexing surfaces 48*a*. Therefore, when the non-rotating shank 18 of the spade bit cutting tool 14 is placed within the bore 44, the flat indexing surfaces 22*a* (three surfaces shown in phantom in FIG. 14) are engaged only by the flat indexing surfaces 48*a* created by the broach. There will be a gap 158 between the flat indexing surface 22*a* and the curved surface 156*a* of the bore 44. This gap 158 will minimize buildup of residual material between the shank 18 and the bore 44 in the region of the non-cylindrical portion 44. This same broaching arrangement may be applied to the entire bore 152 described with respect to FIGS. 12 and 13 herein.

In the illustrations, there are six flat indexing surfaces 22*a* on the shank 18 and six corresponding flat indexing surfaces 48*a* within the bore 44 of the block 50. However, in order to non-rotatably secure the shank 18, it is necessary to have only one indexing surface 48*a*. This number preferably will be at least one, and may be as many as needed to properly secure and index the spade bit cutting tool 12. In some instances, the number of flat indexing surfaces 22 of lower portion 22 of spade bit cutting tool 12 may be as many as four, six or eight to form a square, hexagon or octagon in cross-section. The spade bit cutting tool 12 can be set within the support block 10 at different rotational positions to provide various angles depending on the number of indexing surfaces of spade bit cutting tool 12 and bore 44 of support block 10 (FIG. 10) or bore 152 of support block 50 (FIG. 12). As is well known in the art, these angles for positioning the spade bit cutting tool 12 relative to a drum, wheel or chain are necessary depending on whether the material is to be removed, mixed, shaved or conveyed.

As can be appreciated, according to the embodiments of the invention, either the spade bit cutting tool 12 or the conical bit cutting tool 14 can be easily inserted into bore 44 of support block 10 or bore 152 of support block 50 depending on whether the material to be worked is soft or hard. The above features of the bore 44 of support block 10 create areas in the smaller diameter portion 48 that are now larger than the diameter of shank 30 of conical bit cutting tool 14 such that these openings allow for fine cut material to pass easier from the bore openings to assist in better rotation of the conical bit cutting tool 14.

Even though the bore 44 of the support block has been described and illustrated as having an upper cylindrical portion 46 and a lower non-cylindrical or indexable portion 48, it is to be appreciated that these portions 46, 48 can be switched around without departing from the invention. Also, in this instance, it is obvious that the upper cylindrical portion 20 and the lower non-cylindrical portion 22 of the shank 18 of the spade bit cutting tool 12 can be switched around to fit this new configuration for bore 44 and, furthermore, the upper cylindrical portion 40 and the lower cylindrical portion 42 of the conical cutting tool 14 can be switched around to fit this new configuration for bore 44.

So far discussed and illustrated in the figures is a shank, for example, shank 18 in FIG. 8, having a cylindrical portion 20 with a diameter D1 and a non-cylindrical portion 22 having a maximum width 48*c* (See also FIG. 4A). As illustrated in FIG. 8, the diameter D1 of the cylindrical portion 20 is greater than the maximum width 48*c* of the non-cylindrical portion 22. This same relationship holds true for the cylindrical portion 46 of the bore 44 and the non-cylindrical portion 48 of the bore 44. However, the purpose for these different dimensions is to accommodate the configuration of many currently available tools.

Figure 15:
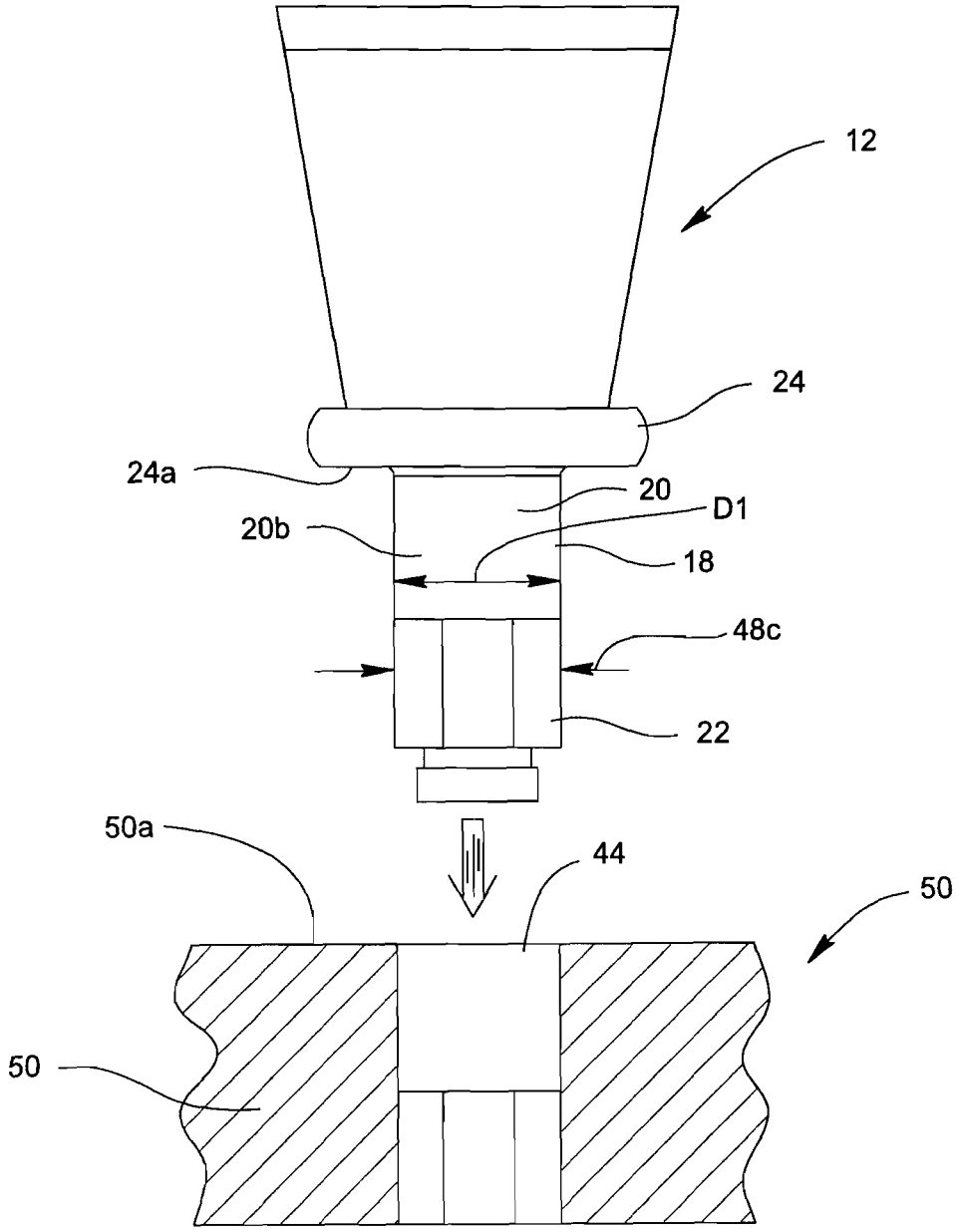
FIG. 15 is an exploded side view similar to that illustrated in FIG. 8, but with the tool shank having a constant width.

It is possible, as illustrated in FIG. 15, for the diameter D1 of the cylindrical portion 20 of the shank 18 to be approximately equal to the maximum width 48*c* of the non-cylindrical portion 22 of the shank 18 with the configuration of the bore 44 shaped accordingly. By doing so, the bottom surface 24*a* of the flange 24 of cutting tool 12 will act as a locating surface in conjunction with the outer surface 50*a* of the support block 50 to locate the tool 12 within the support block 50.

Directing attention again to FIG. 16, what has been discussed so far are a shank 318 and a bore 344, each having a single cylindrical portion 320, 346 and a single non-cylindrical portion 322, 348. While this arrangement is entirely acceptable, any torsion transmitted to the cutting end 316 of the tool 312 will be transmitted along the shank to the non-cylindrical portion 322 of the shank 318. As a result, the cylindrical portion 320 of the shank 318 is placed in torsion.

Figure 16:
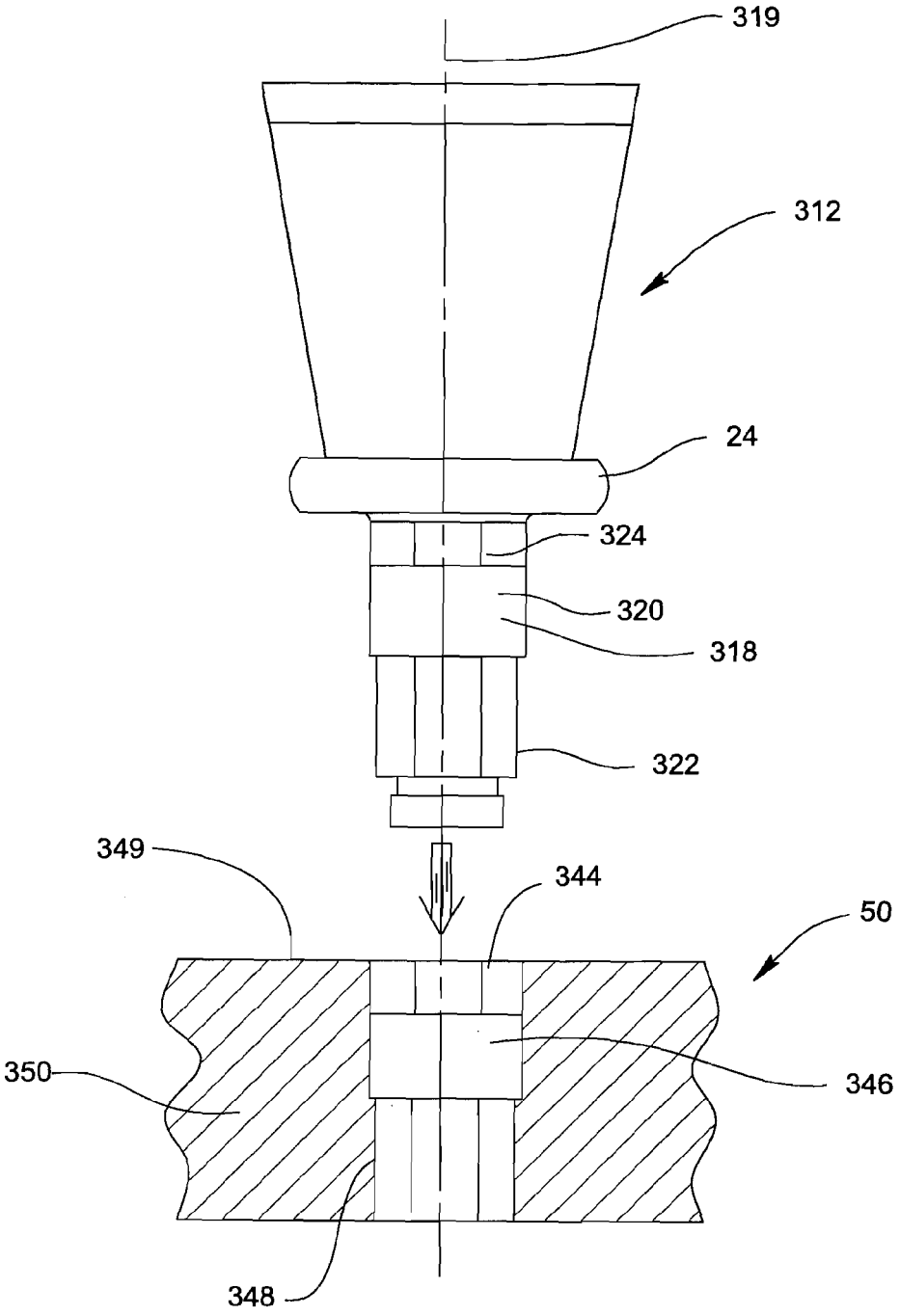
FIG. 16 is a view similar to that illustrated in FIG. 8, but with the shank and the block bore each having a cylindrical portion and two non-cylindrical portions.

Directing attention to FIG. 16, an alternate embodiment includes a shank 318 having a central axis 319 extending therethrough. The shank 318 includes a cylindrical portion 320 with a first non-cylindrical portion 322 located along the central axis 319 on one side of the cylindrical portion 320 and a second non-cylindrical portion 324 located along the central axis 319 on the other side of the cylindrical portion 320. Furthermore, the support block 350 includes a bore 344 extending along the central axis 319 and a cylindrical portion 346. A first non-cylindrical portion 348 is located along the central axis 319 on one side of the cylindrical portion 346 and a second non-cylindrical portion 349 of the bore 344 is located along the central axis 319 on the other side of the cylindrical portion 346 of the bore 344. As a result, any rotation transmitted to the cutting tool 312 will be transmitted to both the first non-cylindrical portion 322 and the second non-cylindrical portion 324 of the shank 318, which in turn will be transmitted to the associated non-cylindrical portions 348, 350 within the bore 344 of the support block 350. While the shank 318 and the bore 346 in FIG. 16 are illustrated with cylindrical portions having a diameter and the non-cylindrical portions having a width different than the diameter, it should be appreciated that the diameter of the cylindrical portion and the width of the non-cylindrical portion may be equal in a fashion similar to that illustrated in FIG. 15.

The present invention has been described with reference to the preferred embodiments. Obvious modifications and alterations will occur to others upon reading and understanding the preceding detailed description. It is intended that the invention be construed as including all such modifications and alterations.

The invention claimed is:

1. A system with a rotatable cuttting tool, comprising:

a support block having a bore with a central axis extending therethrough and with a cylindrical portion and a first non-cylindrical portion, wherein both portions of the bore extend through a common single part and the non-cylindrical portion of the bore is fixed relative to the cylindrical portion of the bore, wherein the support block has a top surface and is configured to accept the rotatable cutting tool for mounting and securing to the support block, with the rotatable cutting tool having a cylindrical shank extending within the bore such that the cylindrical shank is rotatably supported by the cylindrical portion of the bore and is freely rotatable within the first non-cylindrical portion of the bore;

wherein the cylindrical portion of the bore is adjacent to the top surface of the support block and the non-cylindrical portion is spaced from the top surface of the support block;

wherein the support block is also configured to accept a non-rotatable cutting tool for mounting and securing to the support block with the non-rotatable cutting tool having a shank with a first non-cylindrical portion that is configured to engage the first non-cylindrical portion of the bore in the support block;

wherein the cylindrical portion of the bore has a diameter and the non-cylindrical portion of the bore has a width, such that the maximum width of the non-cylindrical portion is less than or equal to the diameter of the cylindrical portion of the bore; and the rotatable cutting tool having a cylindrical shank mounted within the support block bore, wherein the cylindrical shank of the rotatable cutting tool includes a first cylindrical portion that is freely rotatable within the first non-cylindrical portion of the bore and a second cylindrical portion that rotatably engages the cylindrical portion of the bore.

2. The system of claim 1, wherein the cylindrical portion and the first non-cylindrical portion of the bore of the support block are located adjacent to each other within the support block.

3. A system with a non-rotatable cutting tool, comprising:

a support block having a bore with a central axis extending therethrough and with a cylindrical portion and a first non-cylindrical portion, wherein both portions of the bore extend through a common single part and the non-cylindrical portion of the bore is fixed relative to the cylindrical portion of the bore, wherein the support block has a top surface and is configured to accept a rotatable cutting tool for mounting and securing to the support block with the rotatable cutting tool having a cylindrical shank extending within the bore such that the cylindrical shank is rotatably supported by the cylindrical portion of the bore and is freely rotatable within the first non-cylindrical portion of the bore;

wherein the cylindrical portion of the bore is adjacent to the top surface of the support block and the non-cylindrical portion is spaced from the top surface of the support block;

wherein the support block is also configured to accept the non-rotatable cutting tool for mounting and securing to the support block with the non-rotatable cutting tool having a shank with a first non-cylindrical portion that is configured to engage the first non-cylindrical portion of the bore in the support block; and wherein the cylindrical portion of the bore has a diameter and the non-cylindrical portion of the bore has a width, such that the maximum width of the non-cylindrical portion is less than or equal to the diameter of the cylindrical portion of the bore; and the non-rotatable cutting tool having a shank mounted within the support block bore, wherein the shank has a first non-cylindrical portion that corresponds to and is configured to engage the first non-cylindrical portion of the bore in the support block.

4. The system of claim 3, wherein the first non-cylindrical portion of the shank of the non-rotatable cutting tool has a polygonal cross-section and the first non-cylindrical portion of the bore of the support block has a polygonal cross-section.

5. The system of claim 3, wherein the first non-cylindrical portion of the shank of the non-rotatable cutting tool includes at least one flat surface and the first non-cylindrical portion of the bore of the support block includes at least one flat surface that engages the at least one flat surface of the shank of the non-rotatable cutting tool.

6. The system of claim 3, wherein the first non-cylindrical portion of the shank of the non-rotatable cutting tool has a maximum width and the shank further includes a cylindrical portion having a diameter, and wherein the maximum width of the first non-cylindrical portion is equal to the diameter of the cylindrical portion.

7. The system of claim 3, wherein the first non-cylindrical portion of the shank of the non-rotatable cutting tool has a maximum width and the shank further includes a cylindrical portion having a diameter, and wherein the maximum width of the first non-cylindrical portion is different from the diameter of the cylindrical portion.

* * * * *